US005992453A

United States Patent [19]

Zimmer

[11] Patent Number: 5,992,453

[45] Date of Patent: Nov. 30, 1999

[54] FLOW-DIVIDING ARRANGEMENT

[76] Inventor: Johannes Zimmer, Ebentaler Str. 133, 9020 Klagenfurt, Austria

[21] Appl. No.: 09/051,809

[22] PCT Filed: Oct. 17, 1996

[86] PCT No.: PCT/EP96/04493

§ 371 Date: Sep. 29, 1998

§ 102(e) Date: Sep. 29, 1998

[87] PCT Pub. No.: WO97/14511

PCT Pub. Date: Apr. 24, 1997

[30] Foreign Application Priority Data

Oct. 17, 1995 [DE] Germany ..... 295 17 100 U

[51] Int. Cl.[6] ..... E03B 7/07; F15B 7/07

[52] U.S. Cl. ..... 137/561 A; 137/883

[58] Field of Search ..... 137/561 A, 561 R, 137/883

[56] References Cited

U.S. PATENT DOCUMENTS

| | | | |
|---|---|---|---|
| 2,734,224 | 2/1956 | Winstead | 137/561 A |
| 3,936,262 | 2/1976 | Hehl | 137/561 A |
| 4,017,240 | 4/1977 | Nelson | 137/561 A |

FOREIGN PATENT DOCUMENTS

| | | |
|---|---|---|
| 472050 | 2/1992 | European Pat. Off. . |
| 31 02 132 | 8/1982 | Germany . |
| 92 18 012 | 8/1993 | Germany . |
| 94/17927 | 8/1994 | WIPO . |

*Primary Examiner*—A. Michael Chambers
*Attorney, Agent, or Firm*—Beall Law Offices

[57] ABSTRACT

The invention concerns a flow-dividing and conversion arrangement (1) comprising a dividing system in which a substance is guided to a series of openings (3) from a total flow channel (K1) guiding the substance in a combined flow. At a first division point (T1), the total flow (K1) is branched off into two channels. Each channel end in the preceding stage branches into two channels which divide the flow and deflect the divided flows in opposite directions along the length of the arrangement. In order to improve the dividing function, the total flow channel (K1) merges at the first division point (T1) into two parallel, adjacent sections of partial flow channels (K2*a*, K2*b*) which guide the substance in the same direction. In the regions before, at and after the division point (T1) the flow is rectilinear or at least approximately rectilinear.

16 Claims, 4 Drawing Sheets

Figure 1:
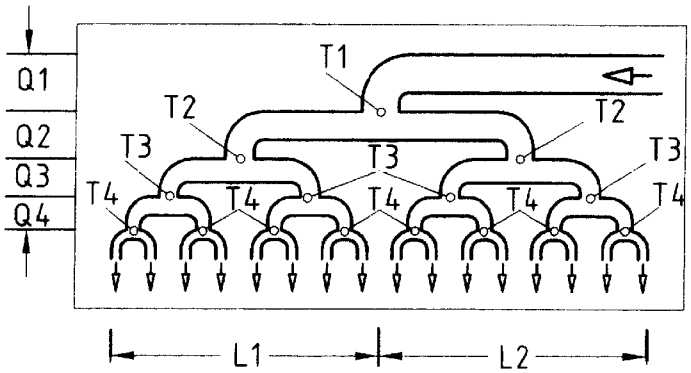
Figure 1:
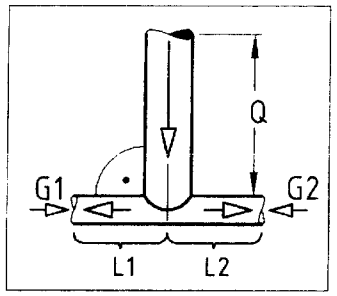
Figure 1:
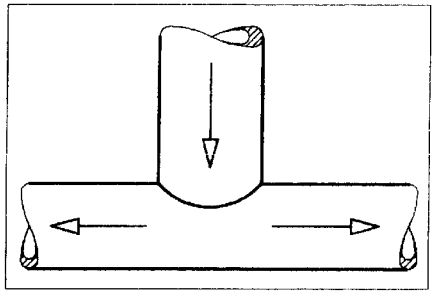
Figure 1:
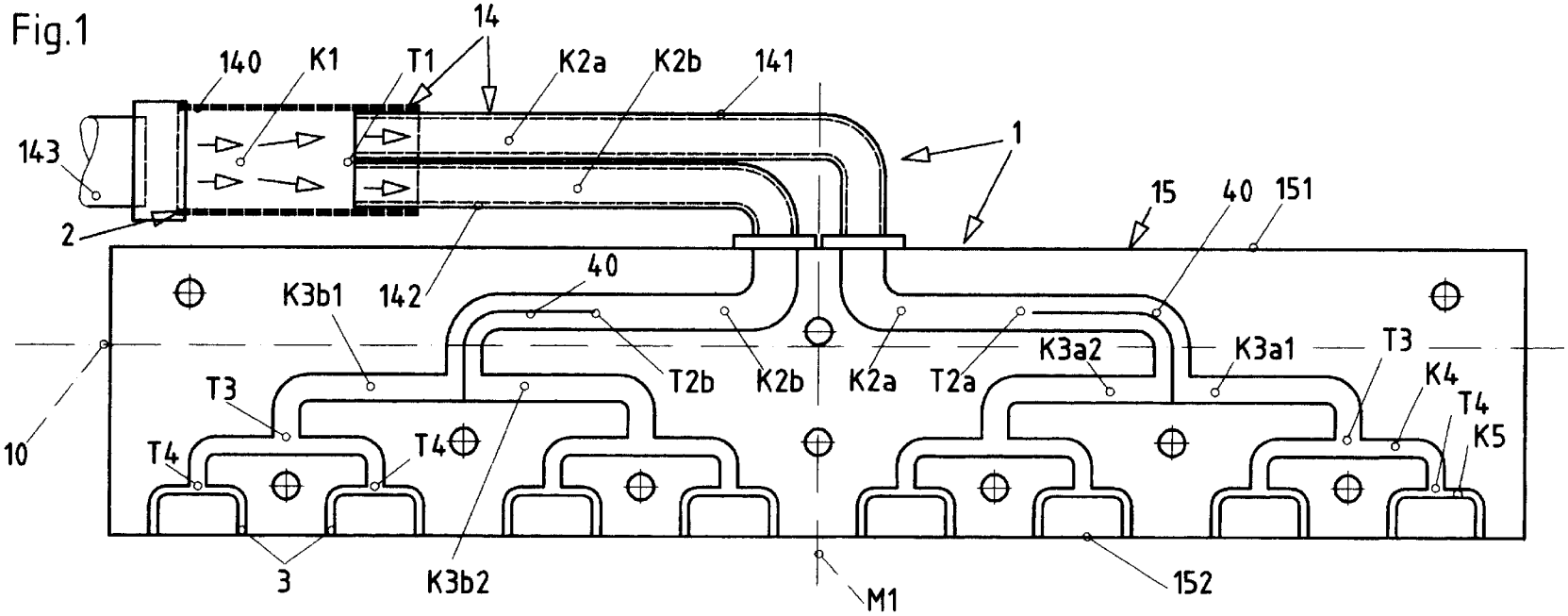

M1
41
42
K2a
K2b
K2a
K2b
4
T1
160
K1
2
16
33
160
16
101
K2b
K2a
K2
a+b
K3
A
B
41
43
45
KR3
KR4
103
17
92
9
80
82
90
300
31
3
42
44
18
K4
102
K5
K6
K7
K8
16
K2
a+b
K3
K2b
K2a
K
4
K
5
K6
K7
102'
32
44
17
91
9
80
81
82

150.1
150
19
K2b
18
41
190
K2a
T1
K1
140
143
11
150.2
18
42
151
K2b
K2a
K2b
K2a
151
K3b
42
K3a
41
140
2
143
V
3

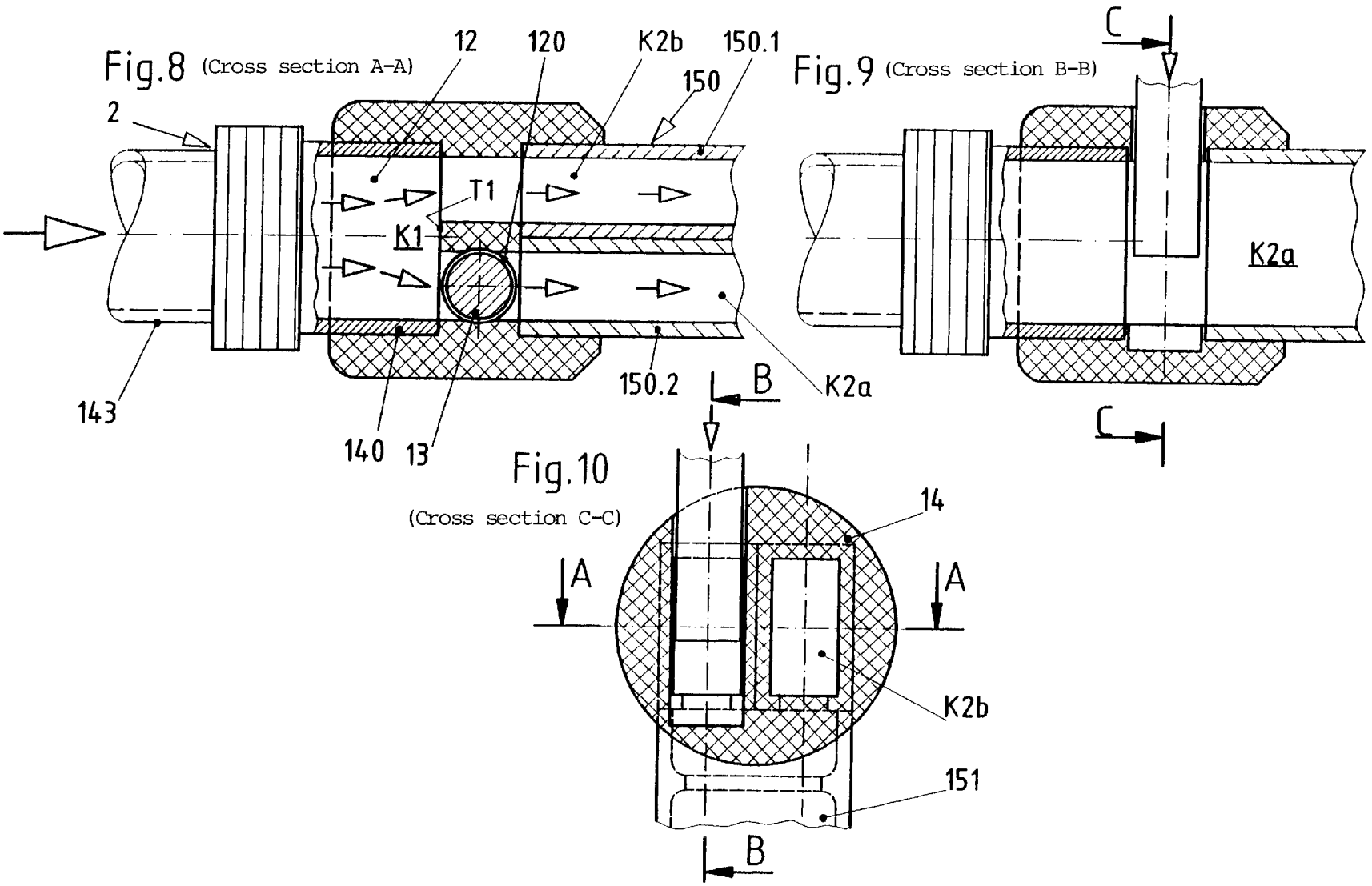
Fig.8 (Cross section A-A)
Fig.9 (Cross section B-B)
Fig.10 (Cross section C-C)

FLOW-DIVIDING ARRANGEMENT

The invention concerns a flow-dividing and deflecting arrangement for the flow division and flow deflection of flowable and/or gaseous substances, comprising an elongate extending structure having a structure longitudinal axis and at least one dividing system in which the substance is conducted from a total flow channel, in which the substance is guided in a combined flow, to a series of openings that are arranged along the length of the structure and associated with a narrow outlet region extending along the structure length, the total flow channel being branched into two substance guiding channels of a first dividing stage that divide the total flow at a first dividing point and at least one further dividing stage, in which each channel end of the previous stage branches off at the associated dividing point into two channels that divide the flow and deflect the latter in opposed directions in the elongation direction of the structure, being arranged subsequently. Two operational functions, in particular in both flow directions, are associated with the flow channel system arranged in the interior of the flow channel structure. The flow channel structure is preferably part of an application arrangement, e.g. a perforated cylinder rotary screen printing machine. It can be incorporated in a carrier beam of such a machine or joined to a carrier beam. However, the flow channel structure can also be utilised for other purposes of uniform fluid distribution over a width.

A flow channel structure of this type is known from WO 94/17927. A total flow channel which starts at a connecting opening arranged at an end face extends up to the longitudinal centre of the flow channel structure. Here, a flow division occurs by means of a T-shaped channel junction. This known flow division occurs directly after a 90° flow deflection from the longitudinal direction to the transverse direction in combination with an appended 90° double deflection which forms the actual division. Known arrangements of the same type satisfy only some of the required demands, and also only within limits. In particular, an arrangement with which the field of very large flow amount rates with all substances from dilute to those of a highly viscous composition and specifically for relatively large working widths, namely in particular 3 to 5 meters, can also be mastered with dividing precision has not existed hitherto. This shortcoming is particularly true in connection with rotary screen printing machines, i.e. in view of the confined spatial conditions of rotary screens. The opening diameter of the most commonly used rotary screens is only 130 to at most 160 mm. The shortcoming exits also with regard to the required stability, i.e. the straightness across the whole structure length. A substantial disadvantage of known flow channel structures can be seen in the imprecision and unreliability of the division, particularly when using substances of very different viscosity and/or amount. The larger the amount of substance, structure length and/or viscosity difference, the more serious the shortcomings become. Some of the shortcomings of the known flow channel structure and fundamentals are described with reference to the schematic FIGS. A to C of the prior art.

FIG. A shows a generally known T pipe junction. In FIG. B there are shown a relatively long flow stretch Q before the flow junction and both of the identically long short T junction stretches L1 and L2 with associated outlet flow resistances G1 and G2. Only when the stretch Q is sufficiently long and the stretches L1 and L2 are of the same length can a halving of the flow be expected. FIG. C shows a known flow channel structure that comprises an elongate plate in which a flow channel system with continued bifurcation is incorporated. The total structure comprises two such plates which are fabricated to be symmetrical and are imperviously joined at the view faces shown in FIG. C. In FIG. C the longitudinal extension of the flow channel structure is shown compressed. It can be considered to be e.g. 10 times as large. Taking as a basis a rotary screen with a diameter of 150 mm, for example, at least 50 mm of this dimension being required for a doctor arrangement, there results, for example with a working width of 3 meters, a proportional relationship between the sectional extension and longitudinal extension of 1 to 30. In FIG. C is shown clearly with Q1 to Q4 that the sectional dimensions of the dividing stages are very short, whereby the already mentioned unreliability for the flow halving results. It is also clear from this that the halving becomes all the less precise as the respective diameter of a flow channel increases. Thus the unreliability of the division in two is at its greatest at a first dividing stage denoted by T1 that however is particularly important for the width distribution. The described proportions are in principle applicable to all hitherto known arrangements of the type concerned.

A principal aim of the invention consists of providing a flow channel structure for the multiple flow division and deflection, in particular for an application apparatus such as a printing machine or the like, with which flow channel structure the substance guidance is essentially improved with regard to the uniform width distribution, and specifically for fluid substances through to viscous substances, also for particularly large working widths, large substance amounts and/or increased production speeds of an application machine, wherein in particular mechanical solidity with a nonetheless small structural section should also be improved.

These aims are achieved in combination with the features of the flow channel structure given in the introduction in that at the first dividing point the total flow channel is converted into two parallel, adjacently running portions of partial flow channels that guide substance in the same direction, the flow in the region in front of, at and after the dividing point running rectilinearly or at least almost rectilinearly. According to the invention the exact halving is particularly achieved in that the flow region before, at and after the dividing point is formed by an on the whole almost rectilinear, linear flow path. In this regard it is also essential according to the invention that the rectilinear flow division is provided at least for the first flow division in the flow channel structure. The flow division occurs independently of first subsequent branching off of direction and flow deflection. As has been found, the division quality is substantially improved as a result of the parallel flow division and only subsequent direction change. The substance division in the first dividing stage according to the invention leads to a substantial improvement of the width distribution, even when subsequent stages are formed with conventional T-shaped junctions. This improvement is obtained for very different substance viscosities, relatively large substance throughput and relatively large working widths. In contrast to known flow channel structures substantially smaller wall widths or, alternatively, correspondingly larger channel sections can be provided in the region of the channel transformation between the first and subsequent stages. In particular, the attainable large channel cross sections in the substance input region and the thereby obtained large flow volumes also permit the use of particularly viscous substances that are just capable of flowing. Furthermore it has been found that the aspiration of substance or gas through the flow channel structure in a direction opposed to the substance distribution that is provided in particular for cleaning purposes can be substantially more effectively carried out as a result of the parallel flow division according to the invention, the aspiration uniformity being then also improved by the parallel joining.

Substance of fluid, selectively viscous or gaseous nature flowing through a pipe connection with a diameter of preferably 20–50 mm that forms a connecting opening is reliably uniformly divided exactly in half in successive dividing stages, i.e. multiply halved, the partial flows extending across lengths of in particular about 2 to 5 meters, i.e. being guided apart and expanded. In an application arrangement, e.g. for rotary screen application, the dimension of the application length corresponds to the web width and therefore to the press width or working width. The outflow of the multiply halved substance over the respective working width occurs in the form of an exiting homogenous substance layer which is uniform over the width. At least there is obtained a close approximation of such a layer, film or wide angle outflow. The outflow of application substance occurs essentially without applied pressure, i.e. almost unpressurized, and close to the application zone. Injected exit under pressure would cause application errors. The flow channel structure according to the invention is also suitable for cleaning purposes, wherein cleaning fluid flows cut at high pressure in contrast to application substance. The flow channels are such that optimal current flow is provided even during reverse flow operation to empty the flow channel system and also for the aspiration of substance and a mixture of substance and water out of the application zone through the region of the outlet opening. The flow channel structure is not only suitable for self-cleaning by the simple through-flow of different substances but is also useful for other cleaning purposes, e.g. for the cleaning of parts of an application apparatus and in particular also for cleaning a rotary screen. After successful cleaning, the cleaning fluid can usefully be removed by allowing the through-low of gas (pressurised air).

The channel that is directly at the end face, joined in particular to a connecting opening having a pipe or hose terminal coupling and that guides the total flow and the subsequent flow path in linear extension having two parallel channel portions up to structure longitudinal centre, can usefully be worked in the structure or be provided in a pipe conduit that extends outside on the structure. The dividing parallel channel portions start preferably in the first third of the path of the rectilinear flow in the region between the structure end face and the structure longitudinal centre but at least at the beginning of the last path quarter. Preferably an interior wall constructed with exact dimensions is arranged in the cross-sectional centre of a pipe to form both the dividing parallel channel portions with this pipe halving. The rectilinearly extending halving flow path preferably comprises parallel channel portions with identical flow sections and identical sectional shape that are bent separately in transverse structure directions and, while remaining separate, out of these into 180° opposing longitudinal structure directions. A particularly advantageous arrangement of the invention consists of the outlet channels being arranged diagonally with respect to the structure longitudinal direction in transverse extension in the narrow substance exit area extending parallel with the structure longitudinal axis. It is particularly advantageous to provide an outlet slit arranged diagonally transverse to the structure longitudinal axis and extending over the whole working width, the outlet slit preferably having a cross sectional width in the range of 0.2 to 2.0 mm and which can usefully be provided by means of a wall joined from outside to the flow channel structure.

Particularly in the last dividing stages before, and in, the substance outlet area, the cross sections of the flow channels of the flow channel structure according to the invention and possibly also the flow section of an outlet slit are very advantageously dimensioned in such a way that exiting application substance is practically not pressurized, i.e. flows out largely relieved from pressure and falls downwardly under gravity, while cleaning fluid for cleaning parts of the doctor arrangement is sprayed out in front of the outlet area, and specifically advantageously as if the spray were generated by a wide angle nozzle extending over the working width, a wide angle jet of fluid that is continuous over the working width being generated that has the greatest cleaning strength at a distance of about 20 to 80 mm from the outlet openings or from the outlet slit opening. In connection with this there is provided a substance supply device such as a pump in combination with an optimally constantly transporting supply control to prevent knocking in the substance supply.

The dependent claims refer to other useful and advantageous embodiments of the invention. Particularly useful and advantageous embodiments or arrangement possibilities of the invention will be described in more detail by the following description of the embodiments shown in the schematic drawing. These show FIGS. 1, 1A, 1B, 1C longitudinal side view of a flow channel structure according to the invention in a composed construction having a pipe structure and a parallelepiped structure, FIG. 2 a top view of the part of a flow channel structure according to the invention in partial longitudinal section with a block structure inserted in a pipe structure, FIGS. 3 and 4 a flow channel structure according to the invention in cross section that is composed of several structure parts, FIG. 5 a partial longitudinal side view of the end face region of the flow channel structure according to FIG. 3

Figures 6, 7, 7A:
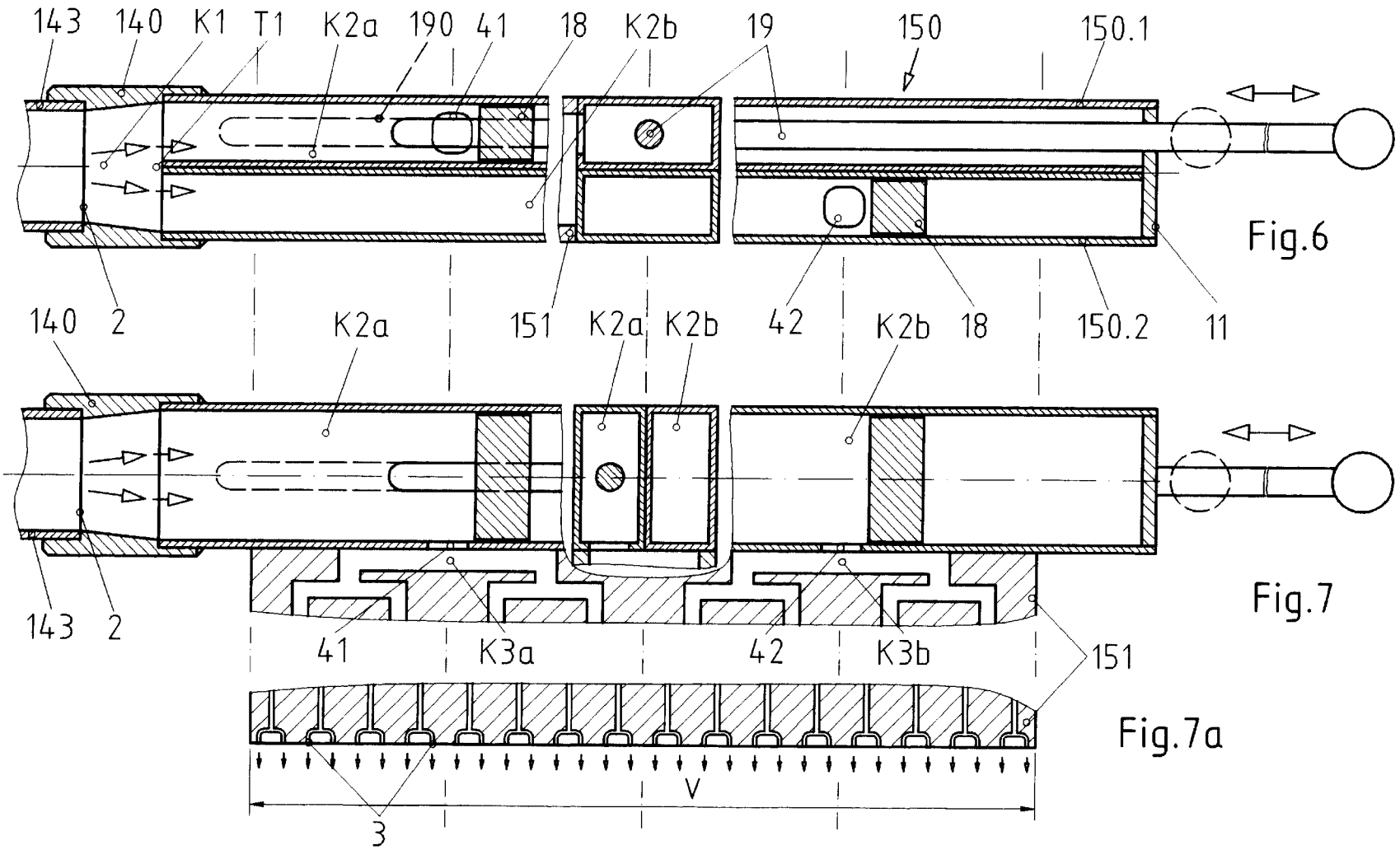

FIGS. 6 to 7*a* a flow channel structure according to the invention in partial longitudinal and cross section FIGS. 8 to 10 a partial longitudinal side view of the flow channel structure according to the invention in partial cross section.

First a flow channel structure 1 according to the invention in an installed state in an application device will be described with reference to FIG. 4.

The flow channel structure 1 is composed of a connecting channel structure 101 comprising a connecting opening and further so-called supplementary channel structures 102 and 103. Usefully the individual structures are surface-adhered to one another. The connecting channel structure 101 comprises a pipe with circular cross section in which two dividing stages are formed. The pipe forms a carrier beam pipe 16 that extends in the apparatus length across the application width of a working application surface 81 such as a web or the like. This is movable in the working direction B in a horizontal position while lying on a magnet table 82. A doctor element in the form of a doctor blade 9 that is equipped with a magnetizable body 92 and is held for rotation by a holding element 91 is pressable with its doctor edge against the web 81, and possibly a perforated cylinder rotary screen 80. The holding element 91 extending underneath the carrier beam pipe 16 is attached, in the working direction B, to a rear wall 17 that extends parallel to the pipe longitudinal axis. The carrier beam pipe is held with its ends in mountings of a application machine which is not shown in more detail, the connecting structure 101 being pivotal about a structure axis parallel to the longitudinal axis and fixable in the pivoted position.

A flow channel structure 1 according to the invention shown in FIG. 1 that will now be described in more detail can, with its carrying structure part 15 which is plate- or block-shaped, usefully also be used as a carrier beam arrangement in an application device. The flow channel structure 1 comprises a pipe conduit 14 composed of pipes 140, 141 and 142 and the solid channel structure 15. The latter extends in an elongate manner along its structure longitudinal axis 10. The pipe conduit 14 is arranged above the upper longitudinal side 151 of the channel structure 15 with which it extends parallel to the longitudinal axis from one end face to the longitudinal centre of the structure.

At the end face the pipe conduit 14 comprises a total channel pipe 140 with rectangular, preferably square, section. A pipe or hose feed conduit 143 can be connected via a coupling connection to the end face connecting opening 2 of the pipe 140. Two straight partial channel pipes 141, 142 lying parallel against one another are inserted to form an impervious connection in the other end of the straight pipe 140. Each pipe 141, 142 comprises exactly half the cross section of the pipe 140, with the exception of the wall thicknesses, in other words advantageously half the square cross section of the pipe 140. According to the invention, the pipe 140 forms the total flow channel K1 in a straight connection with the partial channel pipes 141, 142 which constitute rectilinearly continued portions of partial flow channels K2*a* and K2*b*. The dividing point T1 of the parallel flow division according to the invention is formed at the end face collective input cross sections of the pipes 141, 142. This dividing point T1 is arranged at the end of the first third of the substantially linear rectilinear extension of the pipe conduit 14, as viewed from the connecting opening 2, in the region between the structure end face and the longitudinal centre of the structure. This means that the straight length of each pipe 141, 142 is twice as long as the total flow channel K1.

The half flow pipes 141, 142 are deflected in the region of the longitudinal centre of the structure with a bend of 90° and are flanged to the solid channel structure 15 in symmetrical arrangement about the central transverse plane M1 of the latter. In this way the channels K2*a* and K2*b* are continued by channels having the same section and the same sectional shape as the pipes 141, 142 that are incorporated in the channel structure 15. The continued flow division is effected in the channel structure 15. After the course of the channels K2*a* and K2*b* parallel to the sectional plane M1 and perpendicular to the structure longitudinal axis 10 there occurs a further direction change of 90° in both channels into straight portions of the channels K2*a* and K2*b*, respectively, that extend parallel to the structure longitudinal axis 10 and diverge by 180°.

Subsequent dividing stages can be formed in the conventional way. Then channel portions perpendicular to the structure longitudinal axis 10 branch off at dividing points T3, T4 in the usual way into the two T-arm portions of the subsequent dividing stage. At this point the direction and flow division occurs in the same place, in other words entirely differently from the division according to the invention provided in the first stage. By progressive division the substance flow is divided into the desired number $Z=2^N$ of channels, N being the number of stages. The channel portions of the partial flow channels extending perpendicular to the structure longitudinal axis 10 at the end of this dividing system, namely in FIG. 1 the portions of the channels K5, open into the lower longitudinal side 152 of the channel structure 15 with substance outlet openings 3. Thus in FIG. 1 sixteen outlet openings are provided on the structure underside.

It is particularly advantageous, particularly with multiple stage division, to also equip one or more of the dividing stages following the first dividing stage with the division according to the invention. This is shown in FIG. 1 for the second dividing stage. The straight portion of the channels K2*a* and K2*b* extending in the channel structure 15 parallel to the longitudinal axis of the latter are converted at the corresponding dividing point T2*a* and T2*b*, respectively, into two parallel, adjacently extending portions of the partial flow channels K3*a*1, K3*a*2 and K3*b*1, K3*b*2, respectively. These straight portions are formed, respectively, by means of a portion of a dividing wall 40 which extends in a straight continuation of the channels K2*a*, K2*b*, the partial flow channel portions formed thereby comprising exactly half the flow section of the channels K2*a*, K2*b*. In this way the unidirectional rectilinear flow division according to the invention occurs independently and separately from the first subsequent direction change about 90° in a direction perpendicular to the structure longitudinal axis 10 and then again about 90° in a direction parallel to the structure longitudinal axis 10. The channels K3*a*1, K3*a*2 and K3*b*1, K3*b*2, respectively, are also separated by the dividing wall 40 in the first bend and the subsequent straight portion perpendicular to the structure longitudinal axis 10.

Another embodiment of the dividing structure according to the invention will be described with reference to FIG. 2 which shows the longitudinal section according to view A–B in FIG. 4. A solid structure 160 corresponding in length and section to the pipe 16 is inserted in the carrier beam pipe 16 advantageously in a sealing clamp connection to fit exactly. The channels K1, K2*a*, K2*b* of the division according to the invention as well as the channels K3 of the subsequent dividing stage are formed and incorporated in this inner structure 160.

At the end face a supply conduit 143 is inserted in coupled connection in a connecting opening 2 with circular cross section. From there the flow cross section is converted by a flat convexly arched inner surface to the semi-circular inner cross section of the channel K1 of the pipe 16. In the total flow channel the flow then occurs in a straight path and reaches the dividing point T1. This is formed by the end edge of a dividing wall 4 which extends in the central longitudinal axis 10 of the pipe 16 and exactly halves the semi-circular cross section of the total flow channel K1. By means of this the rectilinearly continued portions of the partial flow channels K2*a*, K2*b* with, respectively, quadrant-shaped cross sections in a first and second upper sectional quadrants are created. The dividing point T1, when viewed in the flow direction from the side of the connecting opening 2, is provided at the end of the first third of the common straight flow path length of the channels K1, K2*a* and K2*b*.

Figures 2, 3, 4, 5:
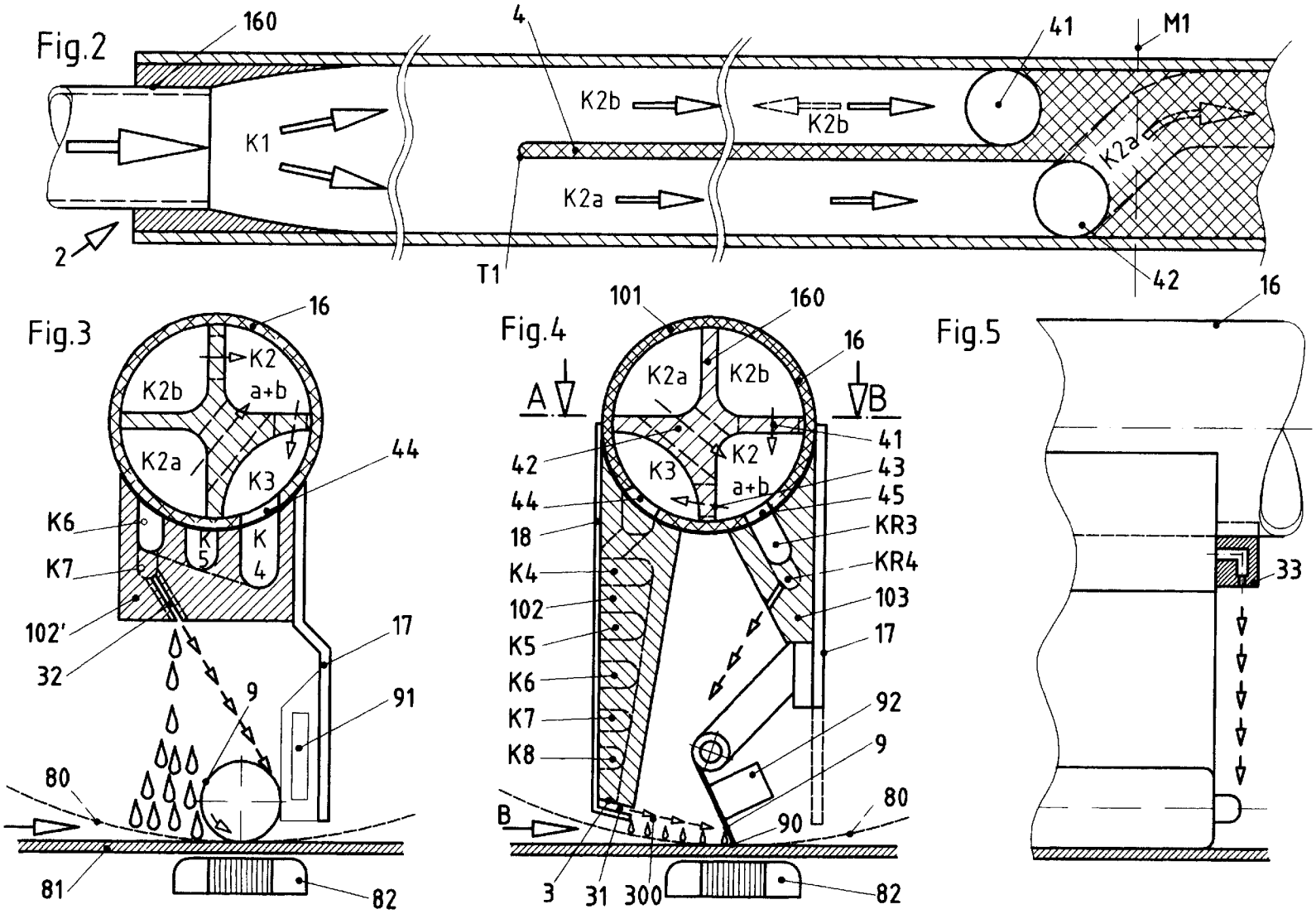

It is clear from the partial longitudinal sectional view according to FIG. 2 in combination with the profile sectional view according to FIG. 4 that the parallel channel portions K2*a*, K2*b* which lie adjacent one another are converted to portions of this channel which extend symmetrically about the central transverse plane M1 that is perpendicular with respect to the structure longitudinal axis 10 into the lower half of the pipe 16, and specifically into the cross sectional region of the third quadrant marked with K2*a*+*b*. In the flow direction, the straight channel portion K2*b* running from the dividing point T1 communicates with the floor opening 41 of circular cross section, as a result of which the flow is deflected by 180°, it being guided back in the longitudinal direction of the pipe in the region of the quadrant K2*a*+*b* towards the end face comprising the connecting opening 2. The portion of the channel K2*b* lying uppermost in the pipe 16 and after the 180° deflection at the bottom has the same quadrant-shaped section.

The portion of the channel K2*a* running from the dividing point T1 passes over to the cross sectional region of the quadrant K2*a*+*b* by means of a slanted diagonal floor through-hole 42 into the portion of the channel K2*a* that is then rectilinearly continued in the other longitudinal half of the pipe 16. The portions of the channels K2*a*, K2*b* running in opposing directions about 1800 in the region of the quadrant K2*a*+*b* have the same length. The division of the channel system is continued in the conventional manner at their ends.

Thus the conversion to a T-division with the respective associated channels K3 having parallel longitudinal axes occurs after a flow deflection about 90° through a passageway 43. As apparent from FIG. 4 the channels K3 extend in the region of the fourth cross sectional quadrant of the pipe 16. It is apparent that with the described cross sectional division of the pipe 16 a carrier beam 16 of particularly high solidity is obtained with a nonetheless material-saving and light-weight construction. The section interior of the pipe 16 or the section of the inner structure 160 has a cruciform structure with the bare quadrant regions for the channels in partial longitudinal portions of the pipe 16. The structural solidity is further increased by concave rounding of the channel walls in the inner sectional corners.

After a 90° bend the channel ends of the channels K3 terminate in through-holes 44 in the wall of the pipe 16, specifically in the outer coating portion of the fourth quadrant. For the continued division the four passages 44 of the second dividing stage that are distributed over the length of the pipe are connected with five subsequent dividing stages. These five dividing stages of conventional type are incorporated in the walls of the supplementary channel structure 102. This extends below the carrier beam pipe 16 to the inner wall region of the rotary screen 80.

It has been found to be advantageous that the pitch dimension between the outlet openings 3 from opening centre to opening centre amounts to 5 to 15 mm. With an operational width of 1600 mm, a pitch dimension of 1600 mm/128=12.5 mm is obtained with the seven stages according to FIG. 4.

As apparent from FIG. 4 the outlet openings 3 open into a diagonal slit 31 which extends over the working width and is open towards the doctor element 9 along this length with a slit opening in the region of the contact zone 90. In section the slit 31 is directed towards the application surface 81 at an obtuse angle. It has been found that the slit width measured in cross section (distance between the slit walls) advantageously amounts to 0.5 to 1.5 mm. It has become apparent that this dimensioning, advantageously when combined with the pitch dimension for the outlet openings in the region of 0.5 to 1.5 mm, is very favourable, particularly when at least the first stage of the dividing system formed by the multiple division is formed with the flow division and deflection according to the invention. Tests have shown excellent width distribution results for very different flow amounts, viscosity and flow rate.

The nozzle length of the slit 31 directed diagonally towards the doctor element 9 lies preferably in the region of 5.0 to 25 mm.

A surprising and very advantageous double effect is attained, in particular with the given dimensions. On the one hand, the substance to be applied exits downwardly practically vertically under gravity in a uniform layer that is continuous over the application width out of the slit opening, while, on the other hand, the slanted slit 31 forms a type of wide angle nozzle for cleaning fluid that emits cleaning substance in the diagonal direction of the slit onto the doctor element. On the one hand, the exit of the application substance in a region of about 20 to 80 mm in front of the doctor contact line has proved particularly advantageous and, on the other hand, it has been found that the cleaning action of the wide angle jet at a distance of 20 to 80 mm is optimally utilizable.

The flow channel structure according to the invention in FIG. 4 is provided with a supplementary channel system for cleaning purposes. This channel system comprises, on the one hand, the channels K1, K2*a* and K2*b* of the parallel flow division and guided deflection according to the invention and also additionally the channels KR3 that are connected to the ends of the channels K2*a* and K2*b* and form a conventional T-channel dividing stage, a further T-channel dividing stage with channels KR4 being arranged subsequently. The channels KR3 and KR4 of the second and third dividing stages are incorporated in the supplementary channel structure 103. The latter is additionally joined to the carrier beam pipe 16 in common with the supplementary channel structure 102, a closable opening 45 being provided at the end of each channel K2*a* and K2*b*, respectively, in the wall of the pipe 16. Then, when the flow channel structure is supplied with cleaning fluid through the connecting opening 2, the opening 45 is opened so that cleaning fluid also arrives in the second dividing system. Advantageously the eight channels KR4 also terminate in an elongate slit that is directed diagonally to the exit region of the application substance and incorporated in the structure 103. As a result of this slit nozzle for cleaning fluid the inner surface of the channel structure 102 can advantageously be cleaned in the region of the exit area 300.

The cleaning function has proved to be particularly favourable and effective with regard to then nozzle action and wide angle distribution in combination with the first dividing stage according to the invention.

In the embodiment according to FIG. 3 a carrier beam pipe 16 is constituted as for the embodiment according to FIGS. 2 and 4. However, a supplementary channel structure 102' is provided which covers the entire underside of the pipe 16. Three dividing stages of construction with conventional T flow division are incorporated in the supplementary channel structure 102'. The pipe 16 and the structure 102' are preferably imperviously joined together by adhesion, the channels K4, K5 and K6 thereby being covered in their longitudinal extension by the pipe outer coating at the side from which they have been worked into the structure 102'. The carrier beam pipe 16 in FIG. 3 is rotated with respect to that of FIG. 4 such that the channels K3 come to lie in the region of a rear wall in the working direction B. This spatial arrangement favours the provision in this area of the connection with the channels K4 via openings 44.

The rear longitudinal wall 17 attached to the carrier beam pipe 16 and bordering the partial structure 102' extends close to the inner surface of the rotary screen 80. In the region of its lower edge is arranged a permanent magnetic sliding or holding part 91 for a magnetizable doctor roll 9.

The exit flow region 300 for substance is provided at the underside of the supplementary channel structure 102' that lies at a distance above the doctor roll 9. The ends of the channels K7 of the last dividing stage terminate in associated slanted pipelets 32. Viewed in the working direction B the pipelets 32 run diagonally downwards and are directed towards the contact region between the doctor roll 9 and the sliding and holding part 91, and specifically perpendicular to the structure longitudinal axis 91. In this way the outlet openings of the pipelets 32, when viewed in the working direction B, lie in front of the doctor roll 9. Here also the double function already described with reference to FIG. 4 is very favourable and advantageous. Upon applying the substance the substance flows under gravity in a substantially vertical direction down to the application surface 81 and forms a substance stock in front of the doctor roll 9. When in cleaning operation the slanted pipelets form a diagonal jet with which the doctor roll is cleaned in its upper region and also in the region of contact with the element 91. It has been found to be particularly advantageous to provide the diagonal pipelets 32 with the same diameter of outlet opening of preferably 3 to 6 mm. It has likewise been proved to be very favourable to arrange the openings in a row with a pitch dimension or 5 to 15 mm. In place of the pipelet row the embodiment of FIG. 3 can also be provided with the diagonal slit channel of FIG. 4.

FIG. 5 shows a partial view of the flow channel structure 1 illustrated in FIG. 3, and specifically only at one end face of the flow channel structure 1. Here an angle nozzle 33 that is connected with a channel K7 and directs a cleaning jet onto the end face end area of the doctor roll 9 is joined to the supplementary channel structure 102'.

FIGS. 6 and 7 show a flow channel structure 1 which comprises a structure part 150 of rectangular section. The structure part 150 extending over the whole length of the arrangement is composed of two joined flat pipes 150.1 and 150.2 of identical cross section. On the end face input side the arrangement corresponds to the previously described embodiments. Thus the feed conduit 143 is connected at the connecting opening 2 to the total channel pipe 140, which is short compared to the total length, and at the exit of the pipe 140, the total flow branches off at the dividing point T1 into the parallel adjacently extending portions of the partial flow channels K2*a*, K2*b*. The rectilinear portion of the channel K2*a* that follows directly after the dividing point T1 is provided substantially shorter than the parallel portion of the channel K2*b*. To this end a seal element 18 in the form of a seal plug is inserted in each channel 150.1, 150.2, the seal element 18 being located in the pipes 150.1, 150.2 directly behind an associated floor opening 41, 42, when viewed in the direction of the flow to be divided. The opening 41 of the channel K2*a* is located in the first quarter of the total arrangement length, measured from the connecting opening, while the opening 42 of the channel K2*b* is located in the third quarter of the total arrangement length. As a result, a length difference between the short portion of the partial flow channel K2*a* and the long portion of the partial flow channel K2*b* of up to half the length dimension, corresponding to half the distribution width V, is obtained.

It is apparent from the lateral partial longitudinal view in FIG. 7 that the openings 41, 42 open directly into the channels K3*a* and K3*b*, respectively, of the subsequent dividing stage. As described above, this and the subsequent dividing stages are formed in a channel structure 151 at the underside of the arrangement 1. FIG. 7*a* shows in part the region of the outlet openings 3 up to which the distribution occurs.

An adjustable throttle element 19 with a displacement portion 190 is usefully associated with the shorter portion formed by the channel K2*a*. In the embodiment of FIGS. 6 and 7 the throttle element is formed by a rod which projects into the flat pipe 150.1 from the end face of the arrangement 11 opposing the connecting opening 2, and penetrates in an impervious sliding fit into a through-hole of the seal element 18 that is parallel to the longitudinal axis. This sliding connection is therefore impervious to substance. The rod extends outside the end face 11 at such a distance and is provided with a handle such that its free end directed towards the dividing point T1 can adopt any desired position between the dividing point T1 and the seal element 18.

As is apparent from the profile sectional illustration of FIGS. 6 and 7—these sectional views are shown between the parts of the discontinuously shown structure part 150—the rod of the throttle element 19 has a circular cross section. With such a cylinder rod the substance flow amount in the short partial flow channel portion can be restricted to such an extent that in both this short portion of the channel K2*a* and the long partial flow channel portion K2*b* the same flow amount of substance is fed into the openings 41, 42. The free end of the rod throttle element 19 thus forms a substance displacement part with an adjustable position. It extends centrally in the flat pipe 150.1 cross section. It is very advantageous that, if necessary, a different substance distribution over the openings 41, 42 can be specifically provided by means of the throttle rod. Further advantages of the arrangement consist in that the flow channel structure can be fabricated with a smaller structure cross section when compared with a structure having identically long channels K2*a*, K2*b* with the same flow rate and it enables the comfortable adaptation to different substance viscosities.

FIGS. 8 to 10 concern an embodiment with a locking element 13 that is arranged in the parallel portion of the partial flow channel K2*a* that is associated with the dividing point. The locking element is formed by a round rod having a circular cross section corresponding to the narrow inner width of the flat pipe 150.1. The locking element 13 is arranged in a pipe connection piece 12 which connects the total flow channel 140 with the double pipe structure part 150.

As apparent from FIGS. 9 and 10 the locking element rod 13 protrudes outside the connection piece 12 by penetrating through an associated through-hole. By operating this protruding portion the inlet opening of the flat pipe 150.1 or the partial flow channel K2*a*, respectively, can be completely closed, and specifically directly at the dividing point T1.

In the embodiment a wall portion 120 of the connecting piece 12 corresponding to the diameter of the rod locking element 13 comes to lie in a clamping manner between the pipe 140 and the structure part 150, the wall portion 120 forming the continuation of the adjacent wall portions of the flat pipe 150.1, 150.2. towards the opening 2.

The total blocking of the channels K2*a* for particular pressure results, e.g. for dyeing flags which have different single colours on each half, can be particularly advantageously utilised. On the other hand the locking element 13 can also usefully be used as a dosing throttle element, as shown in FIGS. 9 and 10, by bringing it into a position which only partially closes the inlet section of the partial flow channel K2*a*. As such the arrangement of the element 13 can particularly advantageously also be provided in combination with the embodiment of FIGS. 6 and 7, and specifically either in addition or instead of the arrangement of the throttle element 19 described there.

I claim:

1. Flow-dividing and deflecting arrangement (1) for the flow division and flow deflection of flowable and/or gaseous substances, comprising an elongate extending structure having a structure longitudinal axis (10) and at least one dividing system in which the substance is conducted from a total flow channel (K1), in which the substance is guided in a combined flow, to a series of openings (3) that are arranged along the length of the structure and associated with a narrow outlet region (300) extending along the structure length, the total flow channel (K1) being branched into two substance guiding channels of a first dividing stage that divide the total flow at a first dividing point (T1) and at least one further dividing stage, in which each channel end of the previous stage branches off at the associated dividing point into two channels that divide the flow and deflect the latter in opposed directions in the length direction of the structure, being arranged subsequently, characterised in that at the first dividing point (T1) the total flow channel (K1) is converted into two parallel, adjacently running portions of partial flow channels (K2*a*, K2*b*) that guide substance in the same direction, the flow in the region in front of, at and after the dividing point (T1) running rectilinearly or at least almost rectilinearly.

2. Arrangement according to claim 1 characterised in that the first dividing point (T1) is provided in the region of the at least almost rectilinear flow path before the beginning of the last quarter of the region and preferably in the first third of the region, when viewed in the direction of the flow to be divided.

3. Arrangement according to claim 1, characterized in that both parallel portions of the partial flow channels (K2*a*, K2*b*) have identical flow sections and preferably also identical sectional forms.

4. Arrangement according to claim 1, characterized in that the portions of the channels (K1, K2*a*, K2*b*) forming the at least almost rectilinear flow path are formed in at least one flow conduit (14) that preferably extends from the structure end face to the structure longitudinal centre and is particularly advantageously connected in the region of the structure longitudinal centre with a channel structure (15) comprising the further dividing stages (FIG. 1).

5. Arrangement according to claim 1, characterized in that the portions of the channels (K1, K2*a*, K2*b*) forming the at least almost rectilinear flow path are formed in a carrier beam pipe (16).

6. Arrangement according to claim 1, characterized in that a channel pipe (14, 16) is provided in which the portions of the channels (K1, K2*a*, K2*b*) forming the at least almost rectilinear flow path are formed such that a dividing wall (4) that extends parallel with the channel pipe over a portion of the length of the latter and with which both the parallel portions of the partial flow channels (K2*a*, K2*b*) are composed is inserted in the channel pipe.

7. Arrangement according to claim 1, characterized in that the flow channel structure (1) is composed of a connecting channel structure (101) comprising the connecting opening (2) and at least one additional supplementary channel structure (102, 103) extending parallel to the longitudinal axis, each supplementary channel structure (102, 103) comprising at least one dividing stage, that a supplementary channel structure (102, 103) is provided with the series of openings (3) and that preferably each supplementary channel structure (102, 103) is arranged in the region between the connecting channel structure (101) and a working surface (81) associated with the flow channel structure (1).

8. Arrangement according to claim 1, characterized in that the parallel and adjacently extending channel portions that guide the substance in the same direction are converted into channel portions of the associated partial flow channels (K2*a*, K2*b*) that extend symmetrically about a transverse plane (M1) directed perpendicularly to the structure longitudinal axis (10).

9. Arrangement according to claim 1, characterized in that at least two separate dividing systems are formed in the flow channel structure (1), one dividing system being provided for the width distribution of application substance and all dividing systems being provided for the wide angle distribution of cleaning fluid (FIG. 4).

10. Arrangement according to claim 1, characterized in that the total flow channel (K1) and the portions of the partial flow channels (K2*a*, K2*b*) and possibly channels (K3) of at least one subsequent stage are arranged distributed with the same volume in the cross sectional and longitudinal extension in the sectional and longitudinal dimension of the flow channel structure or of a flow channel partial structure such as in particular a carrier beam pipe (16), the structure cross section preferably being divided into four quadrants with the same channel cross section apportioned to each quadrant (FIGS. 3, 4).

11. Arrangement according to claim 1, characterized in that at least one subsequent dividing stage is formed in the dividing system in the same way as the first dividing stage with parallel portions of partial flow channels (K3*a*1, K3*a*2) guiding the substance in the same direction (FIG. 1).

12. Arrangement according to claim 1, characterized in that the channels (k7) of the last dividing stage are outlet channels arranged closely spaced in a row with outlet openings of identical cross section of preferably 3 to 6 mm.

13. Arrangement according to claim 12, characterised in that the substance exit region is formed by at least one diagonal channel portion directed transversely, preferably perpendicularly to the structure longitudinal axis (10), preferably either at least one diagonally directed row of outlet pipelets or a diagonal slit (31) continuous over the working length of the flow channel structure (1) being provided and the slit width of the diagonal slit preferably amounting to 0.5 to 1.5 mm in profile section.

14. Arrangement according to claim 1, characterized in that the rectilinear portion of both partial flow channels (K2*a*, K2*b*) associated with the dividing point (T1) are of different lengths, in particular the shorter portion of the one channel (K2*a*) terminating in the first quarter of the total arrangement length and the longer portion of the other (K2*b*) terminating in the third quarter of the total arrangement length.

15. Arrangement according to claim 14, characterised in that an adjustable throttle element (18) for influencing the flow resistance is arranged in the shorter portion of the one channel (K2*a*).

16. Arrangement according to claim 1, characterized in that at least one of both partial flow channels (K2*a*, K2*b*) is closable.

* * * * *